US007685817B2

(12) United States Patent
Carrott

(10) Patent No.: US 7,685,817 B2
(45) Date of Patent: Mar. 30, 2010

(54) METHOD AND SYSTEM FOR PROVIDING A ROTATIONAL OUTPUT USING A NON-COMBUSTION HEAT SOURCE

(75) Inventor: David T. Carrott, Bristow, VA (US)

(73) Assignee: Ceti, Inc., Bristow, VA (US)

( * ) Notice: Subject to any disclaimer, the term of this patent is extended or adjusted under 35 U.S.C. 154(b) by 1203 days.

(21) Appl. No.: 11/248,333

(22) Filed: Oct. 13, 2005

(65) Prior Publication Data

US 2007/0227138 A1 Oct. 4, 2007

Related U.S. Application Data

(60) Provisional application No. 60/618,983, filed on Oct. 18, 2004.

(51) Int. Cl.
*F01B 29/10* (2006.01)

(52) U.S. Cl. ..... 60/512; 60/515

(58) Field of Classification Search ..... 60/512, 60/515

See application file for complete search history.

(56) References Cited

U.S. PATENT DOCUMENTS

| | | | | |
|---|---|---|---|---|
| 3,977,191 | A * | 8/1976 | Britt | 60/509 |
| 4,270,351 | A * | 6/1981 | Kuhns | 60/517 |
| 4,327,305 | A * | 4/1982 | Weber | 378/129 |
| 4,416,113 | A * | 11/1983 | Portillo | 60/513 |
| 4,428,193 | A * | 1/1984 | Papp | 60/509 |
| 5,222,116 | A * | 6/1993 | Eloff et al. | 378/143 |
| 6,272,855 | B1 * | 8/2001 | Leonardi | 60/513 |

* cited by examiner

*Primary Examiner*—Hoang M Nguyen
(74) *Attorney, Agent, or Firm*—Andrews Kurth LLP

(57) ABSTRACT

A system and method for providing a rotational output using a non-combustion heat source. The system may include a sealed chamber and a triggering element. The sealed chamber may contain a substance that expands when heated and contracts when cooled. The sealed chamber may include a displacer capable of moving within the sealed chamber, wherein the displacer moves when the substance is heated and a heat source situated within the sealed chamber. The heat source heats the substance when activated. The triggering element is coupled to the sealed chamber and activates the heat source. The system may include mechanisms for translating the displacer movement into a rotational output or other output.

38 Claims, 9 Drawing Sheets

METHOD AND SYSTEM FOR PROVIDING A ROTATIONAL OUTPUT USING A NON-COMBUSTION HEAT SOURCE

CROSS REFERENCE TO RELATED APPLICATION(S)

This application claims priority from U.S. Provisional Application No. 60/618,983, filed Oct. 18, 2004 entitled "METHOD AND SYSTEM FOR A ROTARY NUCLEONIC STIRLING ENGINE" the content of which is incorporated herein in its entirety to the extent that it is consistent with this invention and application.

BACKGROUND

The United States of America is in need of alternative fuel sources for use in engines and motors. Presently, the US is dependent on the oil industry for combustible fuel to run in internal combustion engines. Alternative sources that have been explored are: fuel cells, solar power, battery, and alternative combustible fuels (i.e., vegetable oils, hydrogen, diesel, etc.). Nuclear power has only been explored in large power generating installations because of public safety issues and the size of the structure.

Even the current state of batteries is in need of change. Electronic devices are consuming more and more electrical power. According to Steve Morgenstern (see, *Got Juice*?, Popular Science, October 2004, p. 61), "We're entering a period when battery capacity, not computing power, is steering product innovation." In the same article Steve quotes Bill Mitchell of Microsoft as saying: "It certainly does seem like something akin to the kind of crisis we experienced during the '70s, when we had all these fuel shortages and lines at the pump . . . and we're not sure how it's going to be solved." The best battery technology today is Lithium-ion polymer, which packs the highest density and can be molded for a particular use.

However, there are not many scientists out there figuring out alternatives to the battery. Again, according to Steve, "[t]he best option for dramatic improvements, in fact, seems to be going with technology that's been around for 50 years: fuel cells." In fact, this technology was a key point in the President Bush's 2004 State of the Union address. He wants to support this technology to reduce the US dependency on foreign oil.

Numerous other engine technologies exist, some of which have existed for some time. The following is a discussion of these technologies and some inherent limitations.

Stirling Engine

A Stirling engine is a thermo-differential engine that gets power from the expansion of heated gas and the contraction of cooled gas. The Stirling engine was invented in 1816 by Rev. Robert Stirling of Scotland. Stirling engines were an alternative to steam at the time and were considered safe because of the lack of a boiler. Stirling engines had many applications including fans, water pumps, and outboard motors. A Stirling engine can run on any external source of heat (direct heat, solar, or geothermal).

The Stirling engine is a completely closed system including a cylinder, with a piston and displacer, in which an enclosed, working gas is usually air, but has also been helium or hydrogen. A connecting rod connects the displacer to a crankshaft via a flywheel. With reference now to FIG. 1, shown is flow diagram illustrating a Stirling engine cycle. As shown, the cycle alternately heats and cools the shifting gas to different thermo locations within the Stirling engine. The cycle includes four phases. The four phases of a Stirling engine are similar to the Otto cycle, which is discussed further on. The four phases are:

Expansion: the gas in the cylinder has been pushed to the hot end of the cylinder. The gas is heated by 1) external heat source heating the cylinder wall, and 2) the compression of the gas, thereby driving the displacer and piston away.

Transfer: with the gas expanded and the most of it in the hot end of the cylinder, the momentum of the flywheel carries the crankshaft the next quarter turn along with both pistons. The bulk of the gas is transferred around the displacer and between the displacer and the piston, or the cool end of the cylinder.

Contraction: with the majority of the expanded gas in the cool end, it contracts drawing the piston into the displacer (slight vacuum).

Transfer: the contracted, or cooled gas is still located near the cool end of the cylinder. The flywheel momentum carries the crankshaft another quarter turn, moving the displacer and transferring the bulk of the gas back to the hot end of the cylinder, and repeating the cycle.

A beta configuration of the Stirling engine is a one cylinder system with a hot end and a cool end. With reference now to FIG. 2, shown is a single-cylinder Stirling engine. The working gas is transferred form one end of the cylinder to the other by a device called a displacer (floating piston). The displacer resembles a large piston, except that the displacer is intentionally made smaller in diameter than the cylinder. Thus, its motion does not change the volume of gas in the cylinder; it merely transfers the gas around the displacer in the cylinder.

An alpha configuration is a two-cylinder system, where one cylinder is kept hot while the other is kept cool, known as a Ross configuration. With reference now to FIG. 3, shown is Stirling engine with a Ross configuration (includes a Ross yoke). The flow linkage allows the engine to be more compact and reduces side loads on the pistons and connecting rods. The travel of the pistons is almost linear.

The limitation of the Stirling Engine is demonstrated by the fact that it requires two connections to the crankshaft. Therefore, an opposing cylinder Sterling engine would be very complex. Practical opposing engines have one connection to the crankshaft per cylinder. This type would include: Volkswagen or Subaru flat four engine, a Porsche flat six engine, or V-series engines such as the V-6, V-8 or V-10. Multiple cylinder Stirling designs have been built and demonstrated, much like the Ross yoke design. But, it should be noted that they are linear in layout, much like the in-line four or six cylinder internal engines. What is needed is a design that allows the Stirling engine to have separate heating and cooling areas, but does not require two separate links to the crankshaft.

Otto Cycle

Internal combustion engines operate using the Otto Cycles, which has four stages: compression, combustion, expansion, and exhaust. With reference to FIG. 4, shown is an Otto Cycle engine. The Otto Cycle stages include:

Compression (1): In preparation for adding heat to the air, the volume is compressed by moving the piston in the cylinder (Adiabatic). It is in this part of the cycle that the engine contributes work to the air. In the ideal Otto cycle, this compression is considered to be isentropic.

Combustion (2): heat is added to the air by fuel combustion when the piston is just past the dead center position. Combustion is not initiated until a spark (from a spark plug, for instance) is generated in the cylinder. Because the piston is essentially immobile during this part of the cycle, we say that the heat addition is isochoric, like the cooling process.

Expansion (3): fuel is burned to heat compressed air and the hot gas expands forcing the piston to travel in the cylinder. It is in this phase that the cycle contributes its useful work, rotating the automobile's crankshaft. The ideal assumption is that this stage is isentropic.

Exhaust (4): expanded air is cooled down to ambient conditions. In an actual automobile engine, this corresponds to exhausting the air from the engine to the environment and replacing it with fresh air. Since this happens when the piston is at the top dead center position in the cycle and is not moving, we say this process is isochoric (no change in volume).

The limitations of the internal combustion engine using the Otto Cycle include: environmental issues of pollution, foreign oil industry dependency, and the up and down motion of the pistons inherent in the design.

Wankel Engine

Ramelli first proposed a rotary engine in 1588, but it was not until the development of the Otto cycle engine in 1876 that the stage was set for a proper rotary combustion engine. Felix Wankel catalogued and organized 862 configurations, investigated 149, and prior to 1910 filed more than 2,000 patents for the rotary engine. The simplicity of design and the dramatic reduction of parts being the key winning factors. The rotary drive matched the rotary output.

With reference now to FIGS. 5A-5B, shown is a Wankel rotary combustion engine ("RCE"). The Wankel RCE is based on the Otto Cycle engine stages with four strokes or phases. The four phases are intake, compression, power, and exhaust. Like conventional piston engines the air must be constantly polluted (mixture with gas), ignited and exhausted, and then replaced by new air. Unlike conventional piston engines, the fuel air mixture is swept along, so the fourth phase takes place in different areas of the engines.

The rotor in a Wankel RCE supercedes the piston engine's reciprocating piston. The eccentric shaft in a Wankel RCE supercedes the piston engine's crankshaft and connecting rod; the peripheral housing of the Wankel RCE supercedes the piston engine's cylinder. The intake and exhaust ports of the Wankel RCE eliminate any values, camshafts, lift rods, and timing belts.

Quantum Nucleonic Reaction

A Nucleonic process is a two-step energy transfer process applied to a heat cycle, where electrical energy is first converted to a higher energy source in the form of X-rays. This type of technology is used everyday in the dentist office to create images of our mouths, or more specifically to find cavities in our teeth. The X-ray energy can also be used to create an even higher energy source in the form of Gamma rays. Both of these high-energy processes produce a large percentage of heat, which until now is considered waste energy to be dissipated away. In the process described below, the byproduct of generating the gamma rays is used to heat the volume within the cylinder, by directly adding energy to the contained gas, and/or indirectly heating the chamber walls which heats the contained gas.

The physics community has an interest in the 4- and 5-quasi-particle isomers of lutetium (Lu), hafnium (Hf) and tantalum (Ta), because they have relatively long half-lives, and high excitation energies. These long half-live are possible because rapid decay is inhibited by the structure of the atomic nuclei. Since rapid decay to a lower energy state is inhibited, these isomers have a relatively long half-life.

The University of Texas, Dallas, found that, in the late 1990s, the Hafnium isomer releases a burst of gamma rays that are ×60 more powerful than the initial X-rays used to exposed the hafnium isomer. It was also found that 90% of the energy released was in the form of waste heat. Hafinia is the Latin name for Copenhagen and is named for the city in which the discovery was made by D Coster and G von Hevesey in 1932. It is a ductile metal with a brilliant silver luster. It properties are influenced by the presence of zirconium impurities. Hafnium has been successfully alloyed with iron, titanium, niobium, and other metals. At 700° C. it rapidly absorbs hydrogen to form the composition of HfH1.86. At elevated temperatures it reacts with oxygen, nitrogen, carbon, boron, sulfur, and silicon. Halogens react directly to form tetrahalides. Finely divided hafnium is pyrophoric and can ignite spontaneously in air. The element is a good absorption cross-section for thermal neutrons (×600 Zi), but also has excellent mechanical properties: extremely corrosion-resistant. It is used for reactor control rods.

X-Rays

X-rays are photons of electromagnetic radiation having wavelengths in the range of 0.1 to 10 nm, between ultraviolet radiation and Gamma rays. An X-ray is capable of penetrating solids and therefore quite useful in the medical and dental profession in examining bones and other calcified minerals.

Common X-ray tube terminology includes discussions of

Focal Spot Size: the measurement of the resolution that is afforded by a particular x-ray tube. This beam coverage is the area covered by the x-ray beam when it gets to its intended target area and is contingent on the anode angle of the tube and distance from the target.

mAs: the amount of energy (amps) applied in seconds. Too much energy with a small focal spot can leave too much energy in the absorbing material or heat.

kVp: the measurement of the energy applied to the electrons that excited the cathode and anode, to generate the x-rays and heat. Too much energy here means too much heat must be dissipated from the target of the x-ray tube.

Duty Cycle: the measurement of how long each exposure will be, or how long between exposures is allowed for cooling.

Gamma Rays

Gamma rays have the smallest wavelength (hi-freq ~$10^{19}$ Hz) and most energy of any photon wave in the electromagnetic spectrum. Gamma rays can kill living cells, a fact which medicine uses to its advantage in use against cancerous cells.

Gamma rays can be absorbed by the Earth's atmosphere or other tangible objects (i.e., metal, skin, water, etc.). These rays are the most energetic form of energy (light) and are produced by the hottest regions of the universe by violent events such as: supernovas, destruction of atoms, or the decay of radioactive material.

The effectiveness of gamma ray shielding is frequently describe in terms of the half value layer (HVL) or the tenth value layer (TVL). These are the thickness of an absorber that will reduce the gamma radiation to half, or a tenth of its intensity, respectively. Typical materials, from worst to best, include: air, water, earth, concrete, aluminum, iron, copper and lead. The values of HVL and TVL are presented as thickness of material (cm).

HVL is the amount of material that is required to reduce the intensity of an X-ray beam to half. For X-ray beams, this is normally expressed in aluminum or copper thickness, but can also be expressed in other materials or media, such as water. Strictly, the half value layer is defined for different quantities: photon fluence (number of photons/$cm^2$), energy fluence (number of photons×photon energy/$cm^2$) or absorbed dose. The term intensity is commonly used but is too vague and should therefore be avoided.

Due to the spectral nature of X-rays, the half-value layer (HVL) is not constant. When measuring multiple half-value layers, the second HVL is greater than the first. This is due to the fact that the mean energy of the X-ray spectrum is increased following passage of the first HVL, which results in the X-rays becoming more penetrating. The most effective gamma shields are materials, which have a high density and high atomic number, such as lead, tungsten, and uranium.

SUMMARY

Embodiments overcome the disadvantages of the prior art and provide a number of advantages described herein. These and other advantages are provided by a system that may include a sealed chamber and a triggering element. The sealed chamber may contain a substance that expands when heated and contracts when cooled. The sealed chamber may include a displacer capable of moving within the sealed chamber, wherein the displacer moves when the substance is heated and a heat source situated within the sealed chamber. The heat source heats the substance when activated. The triggering element is coupled to the sealed chamber and activates the heat source. The system may include mechanisms for translating the displacer movement into a rotational output or non-rotational output.

These and other advantages are also provided by a method for providing a rotational output using a non-combustion heat source. The method includes triggering a nucleonic heat source, heating and expanding a substance within a sealed chamber, moving a displacer in the sealed chamber with the expanded substance to generate a force, and transferring the generated force. The method may also provide a non-rotational output.

These and other advantages are also provided by a rotary engine for providing an output using a non-combustion heat source. The rotary engine includes a sealed, rotary chamber and a triggering element. The sealed, rotary chamber contains a substance that expands when heated and contracts when cooled. The sealed, rotary chamber includes a rotor capable of rotating within the sealed, rotary chamber and a nucleonic heat source situated within the sealed, rotary chamber. The rotor rotates when the substance is heated and the nucleonic heat source heats the substance when activated. The triggering element is coupled to the sealed, rotary chamber and element activates the nucleonic heat source. The rotary engine may generate a rotational or non-rotational output.

These and other advantages are also provided by a Stirling engine for providing an output using a non-combustion heat source. The Stirling engine includes a sealed cylinder and a triggering element. The sealed cylinder contains a substance that expands when heated and contracts when cooled and includes a displacer capable of moving within the sealed cylinder and a nucleonic heat source situated within the sealed cylinder. The displacer moves when the substance is heated and the nucleonic heat source heats the substance when activated. The triggering element is coupled to the sealed cylinder and activates the nucleonic heat source. The Stirling engine may generate a rotational or non-rotational output.

DETAILED DESCRIPTION

Figure 1:
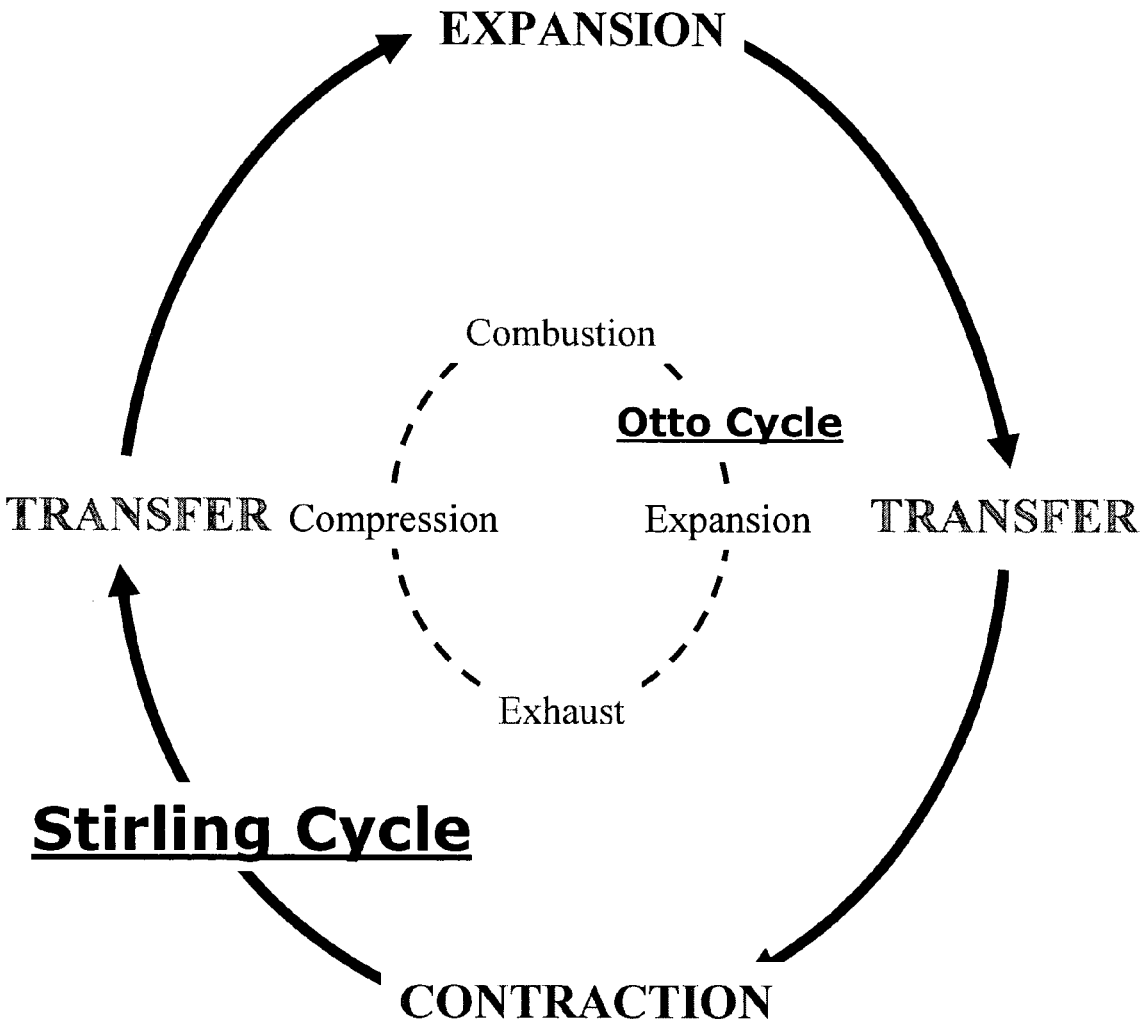
FIG. 1 is a flow diagram of a Stirling cycle flow.
Figure 2:
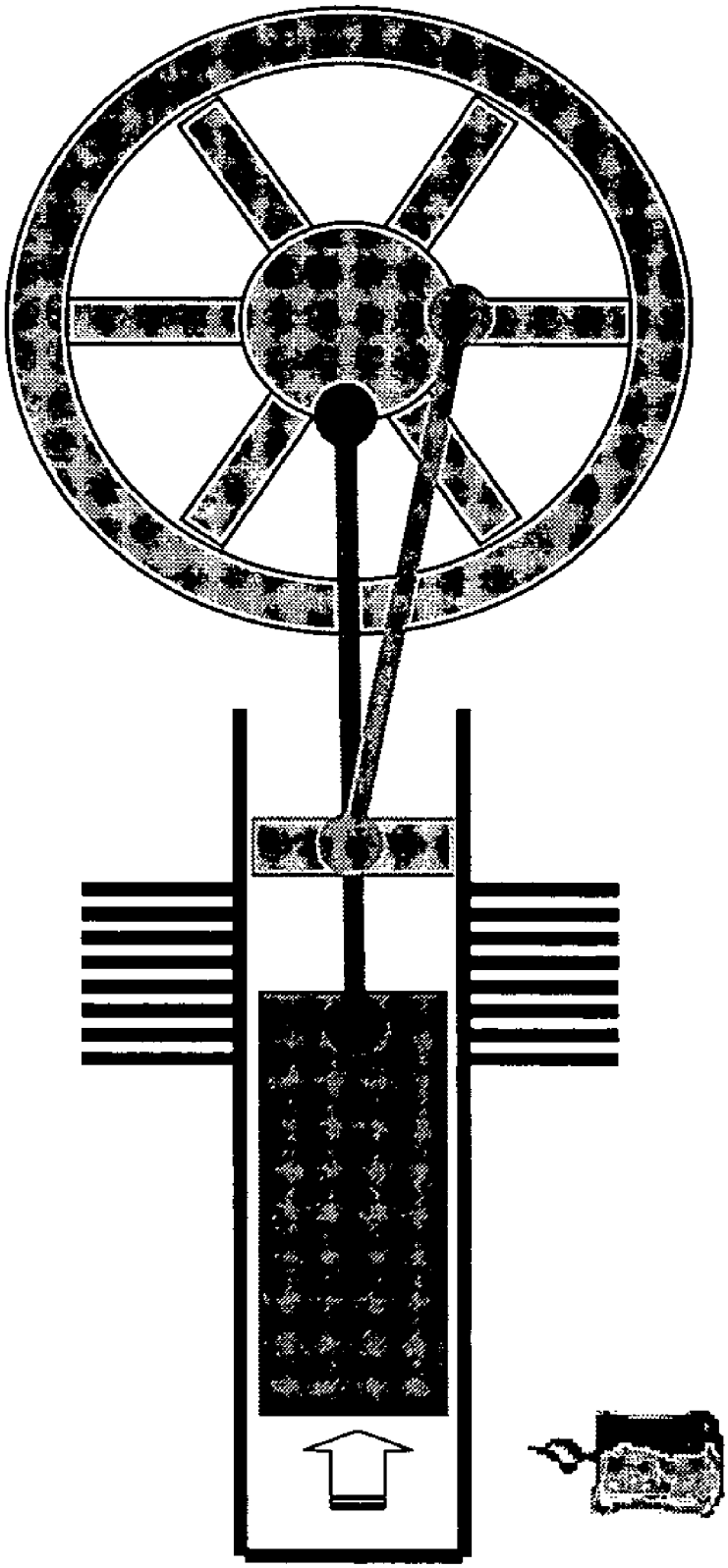
FIG. 2 is a diagram of a single cylinder Stirling engine.
Figure 3:
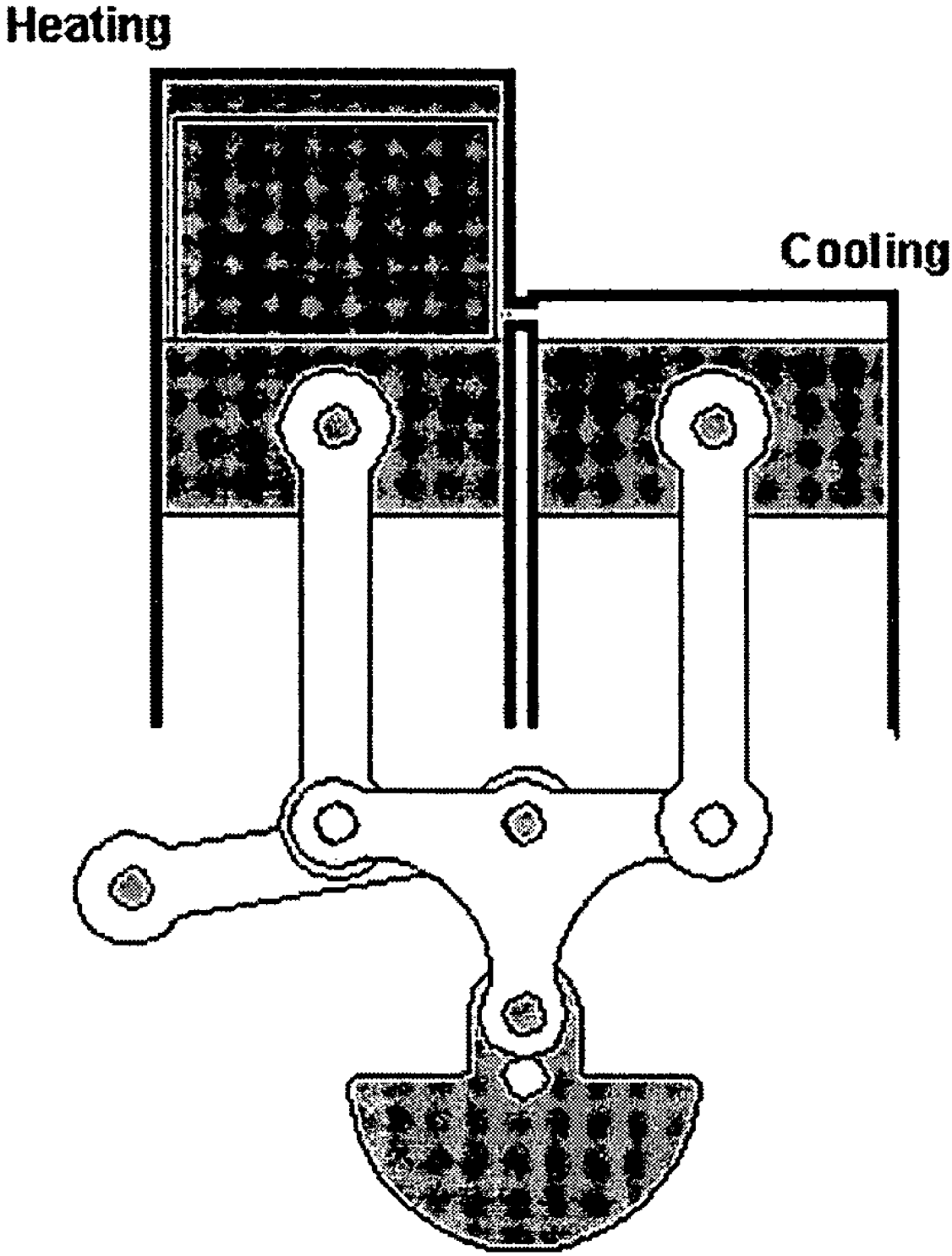
FIG. 3 is a diagram of a Stirling engine with a Ross yoke.
Figure 4:
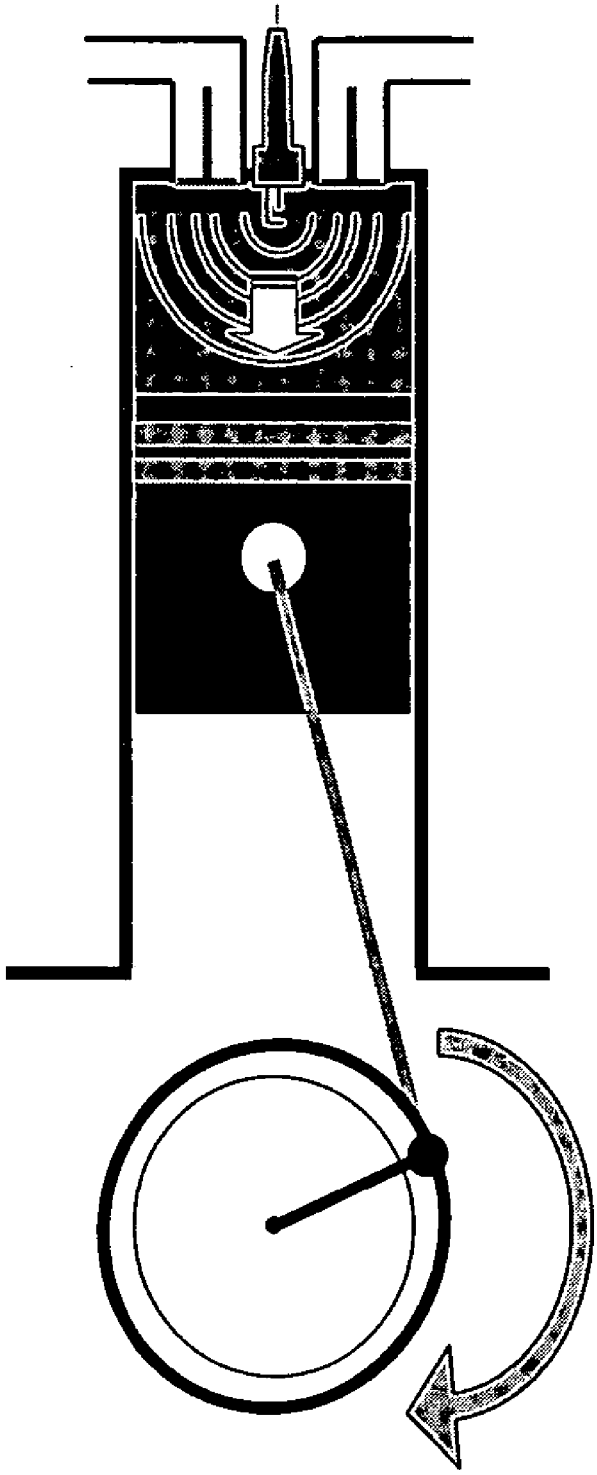
FIG. 4 is a diagram of a Wankel-Rotary combustion engine.
Figure 5A:
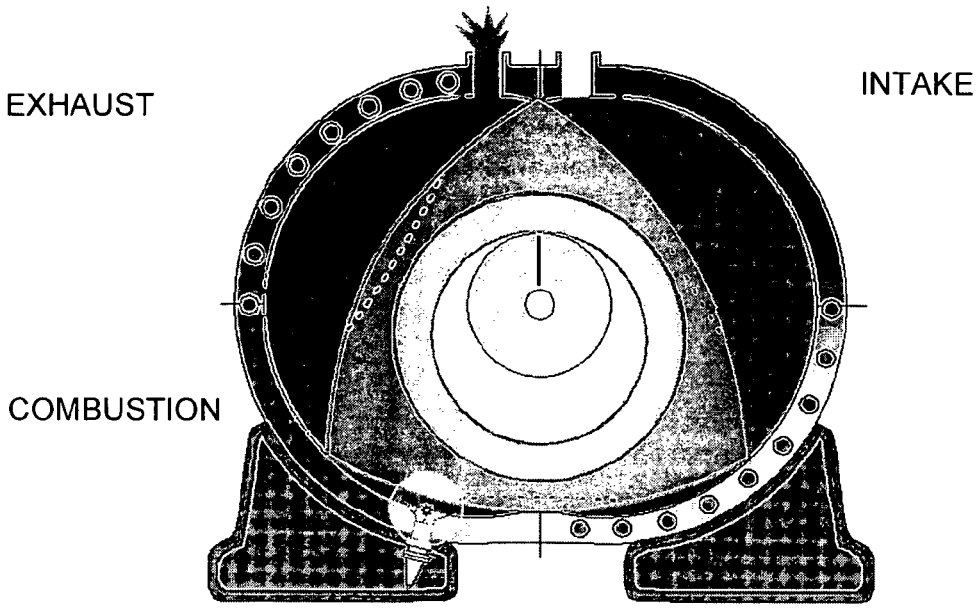
FIGS. 5A-5B is a diagram of an Otto cycle engine.
Figure 5B:
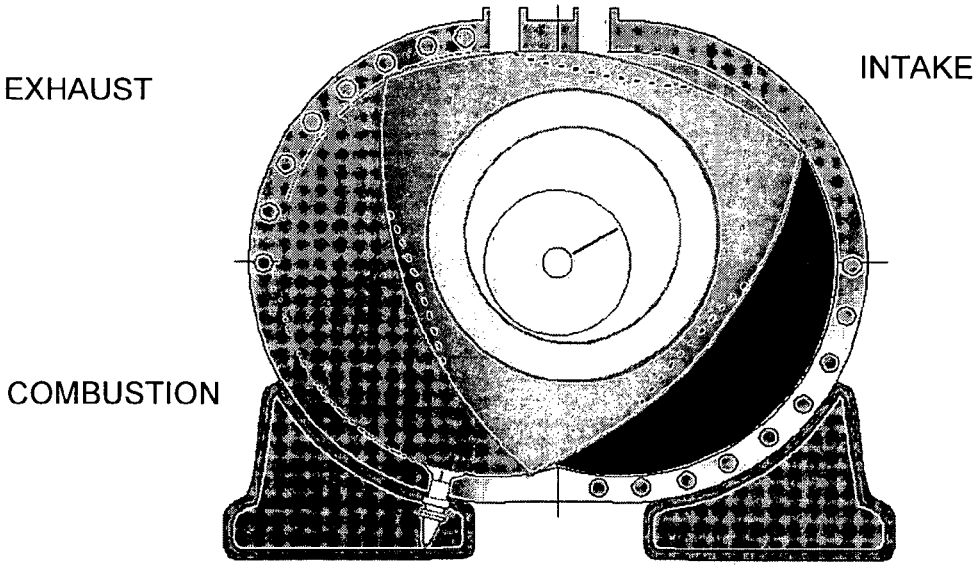
Figure 6:
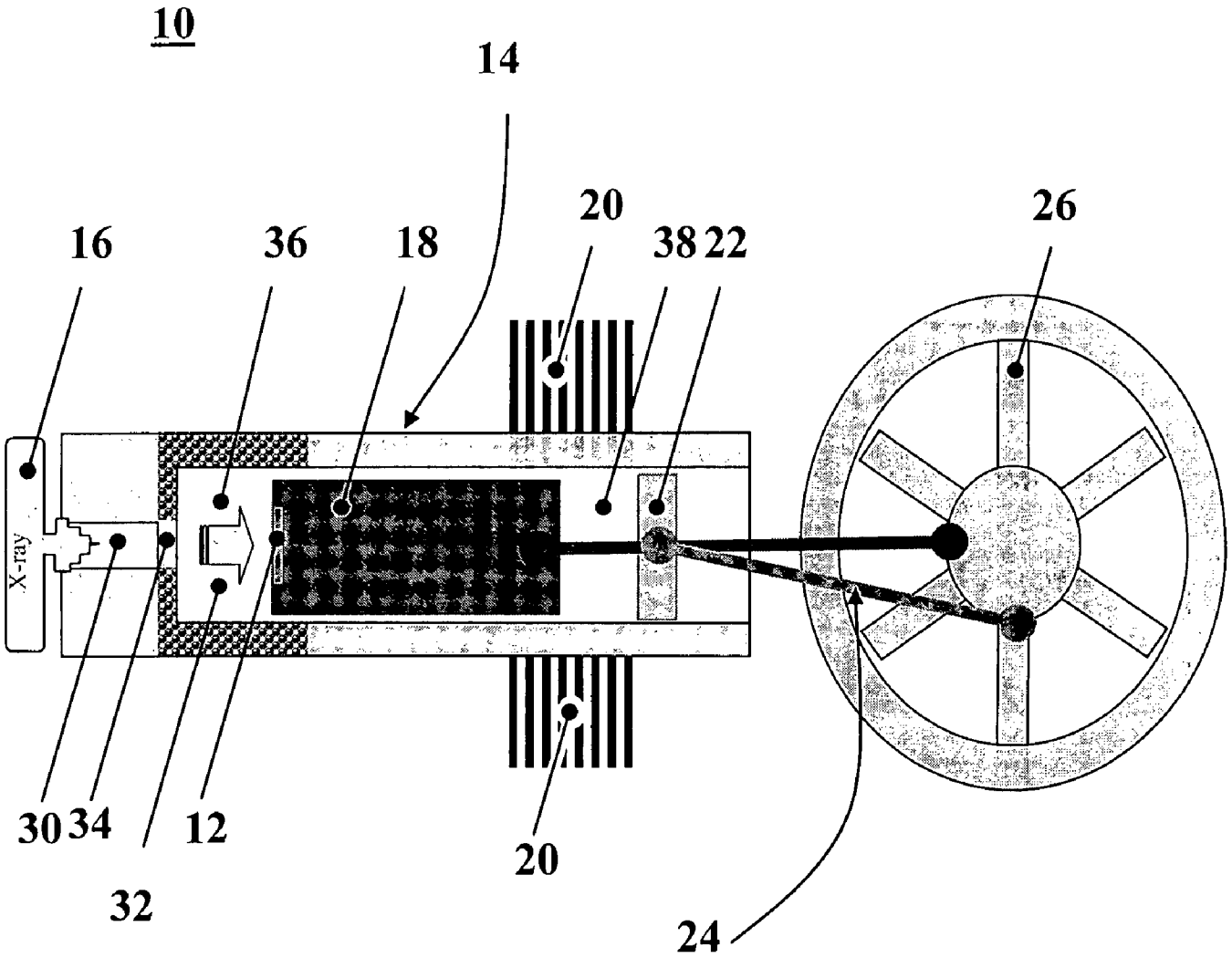
FIG. 6 Is a diagram of an embodiment of a system for providing a rotational output using a non-combustion heat source.

A method and system for providing a rotational output using a non-combustion heat source are described herein. The system and method may produce non-rotational outputs as well. Embodiments of the method and system utilize existing technologies, described above in the Background section, that include limitations that have prevented the technologies being commonly used: the Stirling (or thermal cycle) engine, the Wankel (or rotary) engine as an internal combustion engine, and more recently, nucleonic energy storage, all of which are described in the following. These embodiments combine aspects of these technologies in a manner that not only overcomes their limitations, but also provides a useful alternative to existing, commonly-used combustion engine and battery technologies With reference now to FIG. 6, illustrated is one embodiment of a system for providing a rotational output using a non-combustion heat source. The system applies an internal heat source to a Stirling cycle engine. The embodiment shown is a single cylinder nucleonic Stirling engine 10. The internal heat source is a nucleonic reactor that releases a large amount of heat (95%) and small percent of Gamma rays (5%) when a Hafnium isomer 12 is exposed to X-rays. The heat captured by a cylinder 14 in the engine 10 and cylinder gas enclosed within the cylinder 14 causes the cylinder gas to expand and thereby complete the first cycle of a Stirling engine cycle. The single cylinder nucleonic Stirling engine 10 and its operation are described in more detail below.

Figure 7A:
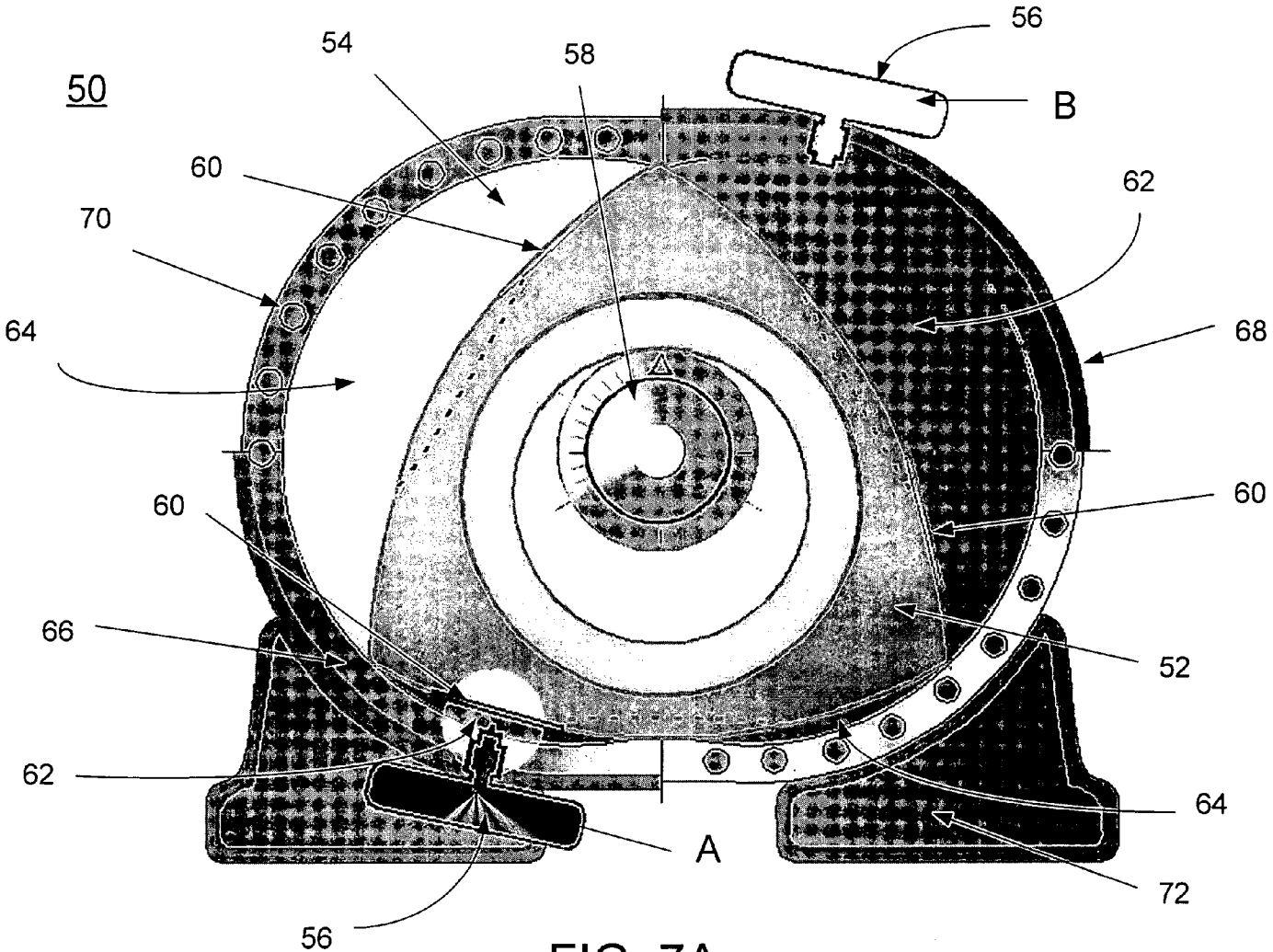
FIGS. 7A-7C are diagrams of an embodiment of a system for providing a rotational output using a non-combustion heat source.
Figure 7B:
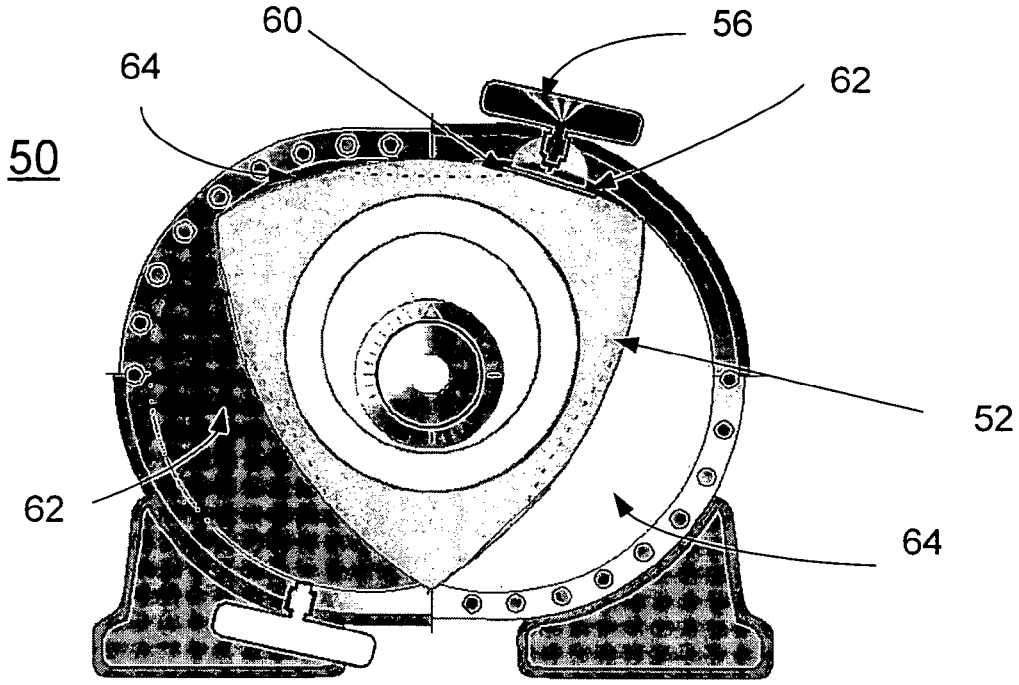
Figure 7C:
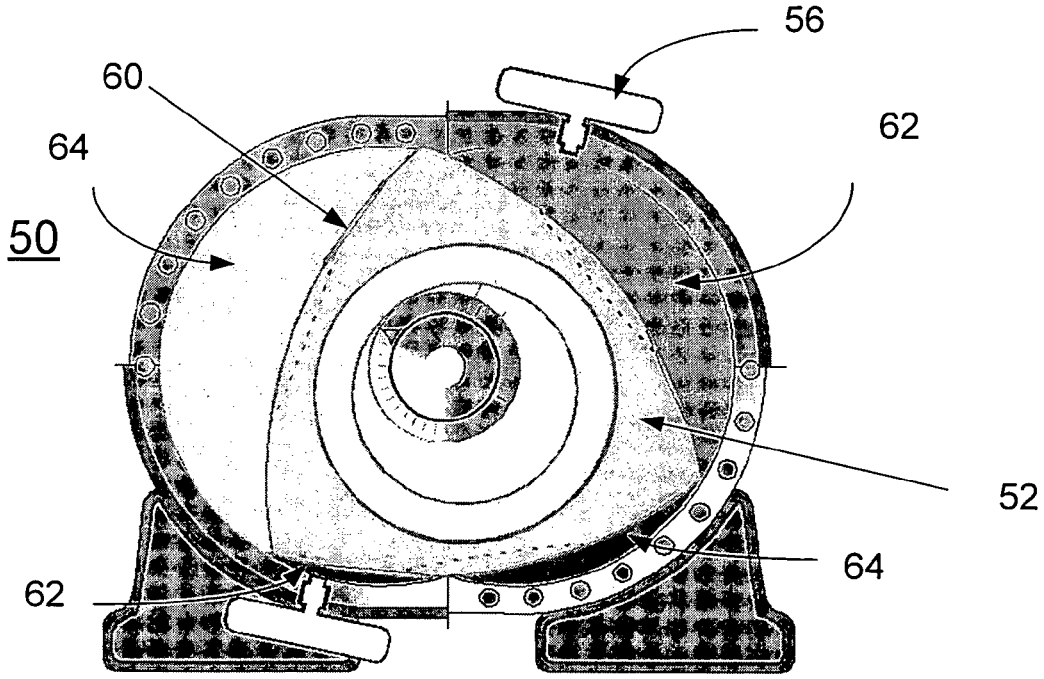

With reference now to FIGS. 7A-7C, shown is another embodiment of a system for providing a rotational output using a non-combustion heat source. The embodiment shown is a rotary nucleonic Stirling engine ("RNSE") 50. The RNSE 50 is based on a unique modification of the Stirling engine cycles and the ability to capture this unique cyclic concept into the simplicity of a rotary design. The RNSE 50 obeys the Otto cycle process, with modifications. The combustion cycle in the RNSE 50 is referred to as the heat cycle and is achieved by non-combustion heat source not internal combustion. Therefore, the RNSE 50 is not an internal combustion engine. The exhaust cycle is ordinarily the removal of hot gas from the system. In the RNSE 50, the exhaust cycle is replaced by a cooling cycle, because no gas is removed. The RNSE 50 and its operation are described in more detail below.

The process of the combustion or heat cycle is based upon an instantaneous reaction of creating heat within the volume. The Ideal Gas Law is maintained here: $PV=nRT$. Where increasing (T)emperature is countered by an increase in (P)ressure and the resulting (V)olume. The increase in pressure and volume drives the RNSE 50.

The mathematics of the embodiments described herein include two parts. The first being that associated with the generation of thermal energy by the isomer (the "Isomer Thermal Energy") and the second is the basic thermal cycle of the nucleonic Stirling engines described herein.

The Isomer Thermal Energy is based on the heat generated in a triggered isomer reaction. This is discussed in Captain Carl Rex Hartsfield's thesis, "Analysis of the Application of a Triggered Isomer Heat Exchanger as a replacement for the Combustion Chamber in an Off-the-Shelf Turbojet," March 2001, Air Force Institute of Technology, herein incorporated by reference, as a heat exchanger replacement for the combustion chamber of a turbojet. According to his thesis, "Two primary performance measures examined were the total decrement across the heat exchanger and the total temperature capability leaving the heat exchanger." The focus of the embodiments described herein is in the latter, temperature capability, as the triggered Isomer would provide a large differential in temperature for use in a Stirling engine design. The following sections describe in sequence the method of nucleonic energy storage, nucleonic energy release, and the use of that energy in the embodiments described herein. (see Stirling Thermal Cycle).

Nucleonic Energy Storage

In his tutorial on Quantum Nucleonics, "Essential Fundamental of Quantum Nucleonics," 1999, herein incorporated by reference, Prof Collins states, "Quantum nucleonics is the study for electromagnetic transitions in nuclei that is most analogous to quantum electronics for atoms. It is rich with potential for application." The latter statement is the course of his investigation in using the nucleonic energy to create a gamma laser, and Capt. Hartsfield's effort to use the energy for a turbojet engine.

Nucleonic energy is similar to the atomic storage of energy, except at the highly confined area within the nucleus. Hence, quantum mechanics dictates that the more compact the structure the potentially higher in energy or velocities of circulation.

Any grouping of particles (i.e., electron, proton, neutron) can radiate electromagnetic waves. The size of the distribution of the charges determines the type of energy most efficiently emitted. Antennas emit radio waves, waveguide structures emit microwaves, electrons oscillating against the positive nuclei in atoms emit light and x rays; are characteristic of quantum electronics. Quantum nucleonics is portrayed by the oscillating motion between higher and lower states within the nuclei; which then emits gamma rays. The oscillating charges in the nucleus emit their energy as short wavelength electromagnetic waves; similar to the way oscillating electron charges release their energy as light. As none of the interior particles of the nucleus escape to cause a nuclear reaction and the atom finishes as the stable (non-radioactive) ground state of the same isotope of the same element; this process is not a nuclear reaction.

The nucleus is the smallest part of an atom which in turn is the smallest structural unit of physical matter. Thus, quantum mechanics teaches that the motions of the charged particles found within the nucleus will represent the highest velocities of circulation possible in a sample of any material.

The fundamental precept described above, quantum mechanics, also means that higher density of (non-nuclear) energy storage will be found in the motions of those charges in nuclei. But, the inverse is also true in that charges can absorb energy of electromagnetic waves and transition to a higher energy state. In rare cases such as a 4-quasiparticle isomer, $^{178}$Hf are able to retain this higher energy state, as if to store the energy. A "quasiparticle" is that nucleonic state defined by quantum mechanics where you have a superposition of equal metastable parts of a proton and a neutron. Such an accidental state does not normally occur, but is it believed to be essential in the release of nucleonics excitation energy stored in other metastables. The 4-quasiparticle isomer of 178Hf has 16 units of angular momentum, which cases this state to have a half-life against spontaneous radiation of 31 years. It has been shown to store 2.445 MeV per nuclei. This is the key to the storage of energy, when Hf is used in a reactor as a control rod. It is also the storage of energy, that when released is non-nuclear and has the potential of sustained levels isothermal energy over a long period of time. Preliminary estimates show that 1.0 grams of Hf (0.50 mm×0.25 mm) produces about 1.3 giga-Joule per gram (See Collins).

Nucleonic Energy Release

Research (e.g. Hartsfield and Collins) shows that this energy can be released by the X-ray energies at 10 to 90 keV. "In this manner, the stored energy can be released at volumetric rates of up to 50 giga-Joules per cubic meter per second" (Hartsfield). As this reaction only releases energy, no partials, there is therefore no change to the hafnium properties. This is further support that this is process is not a sustained or controlled nuclear reaction, but a isothermal reaction.

Stirling Thermal Engine—Theory

The performance of any closed system engine is described by the a basic law of physics, the Universal Gas law, $$PV=nRT \qquad \text{Eq 1}$$

where the engine pressure is based upon a isothermal expansion and compression. This can be expressed using the Schmidt theory. In theory, the following assumptions can be applied:

a. There is no pressure loss in the heat-exchangers and there are no internal pressure differences
b. The expansion process and the compression process change isothermally
c. Conditions of the working gas are changed as an ideal gas
d. There is perfect regeneration (not a real world situation)
e. The expansion dead space maintains the expansion gas temperature, $T_E$, and the compressions dead space maintains the compression gas temperature, $T_C$, during the cycle.
f. The regenerator gas temperature is an average of the expansion gas temperature, $T_E$, and the compression gas temperature, $T_C$.
g. The expansion space, $V_E$, and the compression space, $V_C$, changes according to sine curves.

In the Schmidt theory, the total momental volume can be used to modify the ideal gas law (Eq1)

$$V=V_E+V_R+V_C \qquad \text{Eq 2}$$

where the all the Schmidt symbols are shown in Table 1:

TABLE 1a

Schmidt Theory Symbols

| Symbol | Units | Description |
|---|---|---|
| P | Pa | Engine pressure |
| $V_{SE}$ | $m^3$ | Swept volume of expansion or displacer piston |
| $V_{SC}$ | $m^3$ | Swept volume of compression or power piston |
| $V_{DE}$ | $m^3$ | Dead volume of expansion space |
| $V_{DC}$ | $m^3$ | Dead volume of compression space |
| $V_R$ | $m^3$ | Regeneration momental volume |
| $V_E$ | $m^3$ | Expansion momental volume |
| | $m^3$ | Compression momental volume |
| V | $m^3$ | Total momental volume |
| m | kg | Total mass of working gas |
| R | J/KgK | Gas Constant |

TABLE 1a-continued

| Schmidt Theory Symbols | | | |
|---|---|---|---|
| Symbol | Units | Description | |
| $T_H$ | K | expansion space gas temperature | |
| $T_C$ | K | compression space gas temperature | |
| $T_R$ | K | Regenerator space gas temperature= | $(T_E-T_C)/2$ |

TABLE 1b

| Schmidt Theory Symbols | | | |
|---|---|---|---|
| dx | deg | Phase angle | |
| t | | Temperature ratio | $= T_C/T_E$ |
| v | | Swept volume ratio | $= V_{SC}/V_{SE}$ |
| X | | Dead volume ratio | $= V_a/V_{SE}$ where a = DE, DC, or R |
| n | Hz | Engine rotational speed | |
| $W_E$ | J | Indicated expansions energy | $= \oint PdV_E$ |
| $W_C$ | J | Indicated compression energy | $= \oint PdV_C$ |
| $W_i$ | J | Indicated energy | $= W_E + W_C$ |
| $L_E$ | W | Indicated expansion power | $= W_E n$ |
| $L_C$ | W | Indicated compression power | $= W_C n$ |
| $L_i$ | W | Indicated Power | $= W_i n$ |
| e | | Indicated efficiency | $= W_i/W_E = 1-t$ |

A first embodiment of a system for providing a rotational output using a non-combustion heat source, e.g., a nucleonic Stirling engine 10, incorporates the simplest Stirling engine type, Alpha. As such the calculation of the expansion and compression by volume at a given crank angle can be determined (e.g., see "Schmidt Theory for Stirling Engines," Koichi Hirata, Jan. 20, 1997, herein incorporated by reference). The crank angle is defined to be x=0 when the expansion piston is at top dead center (TDC).

Given the above assumptions, specifically that of (g), then the momental expansion volume is described by:

$$V_E = \frac{V_{SE}}{2}(1-\cos x) + V_{DE} \quad \text{Eq 3}$$

The momental compression volume is then found with:

$$V_E = \frac{V_{SC}}{2}\{1-\cos(x-dx)\} + V_{DC} \quad \text{Eq 4}$$

The total mass in the engine is then a transposition of the equation 2, and the assumption of (a), (b), and (c).

$$m = \frac{PV_E}{RT_E} + \frac{PV_R}{RT_R} + \frac{PV_C}{RT_C} \quad \text{Eq 5}$$

Then equation 5 is changed using the table definitions and equations 3 and 4.

$$m = \frac{PV_{SE}}{2RT_C}\{S - B\cos(x-a)\} \quad \text{Eq 6}$$

which can be transposed back to engine pressure, P $$P = \frac{2mRT_c}{V_{SE}\{S - B\cos(\theta - a)\}} \quad \text{Eq 7}$$

where θ is the crank angle. $P_{min}$ is when cos(x−a)=−1 and the $P_{max}$ is when cos(x−a)=1, then $$P_{min} = \frac{2mRT_c}{V_{SE}\{S+B\}} \quad \text{Eq 8}$$

$$P_{min} = \frac{2mRT_c}{V_{SE}\{S-B\}} \quad \text{Eq 9}$$

Similarly, the total engine pressure, P $$P = \frac{P_{min}(S+B)}{S - B\cos(x-a)} \quad \text{Eq 10}$$

$$P = \frac{P_{max}(S-B)}{S - B\cos(x-a)} \quad \text{Eq 11}$$

Equation 10 and Equation 11 provide enough information to put together a P-V diagram for a Alpha type Stirling engine.

Stirling Thermal Engine—Example

Using the above equations and the following assumptions: $V_{SC}$=0.628 cm$^3$, $V_{SC}$=0.628 cm$^3$, $V_{DE}$=0.2 cm$^3$, $V_{DC}$=0.2 cm$^3$, $V_R$=0.2 cm$^3$, dx=90° (TDC), $P_{mean}$=101.3 kPA, TC=300 K (Ambient), and TE=1068 K (See Hartsfield), the equations provide:

| | |
|---|---|
| Temperature ratio (t) | 0.281 |
| Volume ratio (v) | 1.0 |
| Regeneator Temperature ($T_R$) | 384 |
| Dead Volume ratios ($X_{DE}$, $X_{DC}$, $X_R$) | 0.318 |

Noting that the above $P_{mean}$ and comparing to the total engine pressure, P, during crank rotation of 0° to 90° is:

| | Degree | | | | | | | | | |
|---|---|---|---|---|---|---|---|---|---|---|
| | 0 | 10 | 20 | 30 | 40 | 50 | 60 | 70 | 80 | 90 |
| pressure | 103.3 | 112.4 | 122.3 | 132.6 | 142.6 | 151.4 | 158.1 | 161.5 | 161.3 | 157.3 |

This shows that with a temperature differential of 768 Kelvin degrees, one can sustain a Stirling operation at about 2,000 rpm.

With reference again to FIG. 6, the single cylinder nucleonic Stirling engine 10 includes a heat source (Hafnium isomer 12) and a cylinder 14 that captures heat released by the Hafnium isomer 12 when it is activated. The nucleonic Stirling engine 10 also includes a triggering element 16 (e.g., an X-ray source), a displacer 18, cooling fins 20, a piston 22, connecting rods 24, and a crank 26. The triggering element 16 may a low-level electron-volt (eV) generator of X-rays. For example, the triggering element 16 may be a X-ray source used in the dental industry for producing dental films. The triggering element 16 generates X-rays which cause the heat source, here Hafnium isomer 12, to release heat. Other suitable triggering elements 16 and heat sources may be used.

The cylinder 14 is a modified Stirling engine cylinder. The cylinder 14 includes a energy chamber 30 and a displacer chamber 32. The energy chamber 32 may be bored out, leaving an energy window 34 thin enough to allow X-rays from the triggering element 16 to pass through to the displacer chamber 32 while still maintaining a seal with the displacer chamber 32. The energy window 34 can be a residual of boring out the energy chamber 30 or it can be a ceramic seal able to withstand the pressure and heat of the displacer chamber 34. In the later case, the energy chamber 30 is bored through the cylinder 14 and then capped with a ceramic plug (not shown).

The head of the cylinder in a conventional Stirling engine is heavy and massive in order to maintain a uniform heat from the external heat source. This is not necessary for the system, but will also not interfere with the new heat cycle.

With continuing reference to FIG. 6, the displacer 18 is a floating piston that moves within the displacer chamber 32 as the heat source 12 heats the air within the displacer chamber 32. The displacer chamber 32 includes an upper or heating chamber 36 and a lower or cooling chamber 38. The heat source 12 heats the air in the heating chamber 36, which flows around the displacer 18 and cools in the cooling chamber 38. In order to permit this action, the displacer 18 does not seal the heating chamber 36 from the cooling chamber 38. The displacer 18 is free to be moved back and forth inside the displacer chamber 32 of the cylinder 12, thereby rotating the crank 26. The displacer 18 has a section on top that has been removed and replaced with the heat source 12, in this case a Hafnium isomer plug 12, which will provide the necessary heat factor to the displacer chamber 32.

The cooling fins 20 are used to remove the heat from within the cooling chamber 38. The embodiment shown in FIG. 6 utilizes a typical Stirling engine method of air-cooling.

With continuing reference to FIG. 6, the piston 22 is located in the cooling chamber 38 of the displacer chamber 32 of the cylinder 14. The piston 22 provides a seal that seals the displacer chamber 32 from the external environment and can slide back and forth inside the displacer chamber 32, similar to the displacer 18. When the piston 22 moves towards the crank 26 and the displacer 18 moves towards the triggering element 16, a low-pressure area is created that allows for maximum cooling of the cooling chamber 38 through the cooling fins 20.

The crank 26 provides a rotary motion to the output shaft (not shown) and maintains the timing and motion of both the displacer 18 and the piston 22.

In use, the triggering element 16 (X-ray source) releases X-rays into the energy chamber 30. A large percentage of that energy passes through the energy window 34. The window is not infused with nucleonic isomer alloy and, therefore, the energy is passed to the heat source 12.

With continuing reference to FIG. 6, as noted above, the heat source 12 may be an isomer plug made of Hafnium (Hf), which has been exposed to a nuclear reactor, in the form of a control rod, or otherwise boosted to higher energy levels. As a control rod the Hf material is unaltered. But, the Hf material absorbs the excess energy of the reaction chamber. As such, the Hf energy level is boosted to new levels and will retain that energy level for thousands of years under normal conditions. Alternatively, the isomer plug may be a quasi-particle isomer chosen from a list comprising of Lutetium (Lu), Hafnium (Hf), and Tantalum (Ta).

When the Hafnium isomer plug 12 is exposed to an X-ray source the internal energy bands are released in the form of heat (~95%) and gamma rays (~5%). The heat is used to energize the gas trapped in the displacer chamber 32. The interior walls in this portion of the displacer chamber 32, the heating chamber 36, may contain Hf alloy. As a result, the gamma rays are absorbed by the Hf alloy in the walls, which boosts their energy level and heat, thereby heating the gas in the heating chamber 36. Future exposure to X-rays will release the energy in a smaller proportion of heat. Using Hf alloy in the walls reduces the cylinder 14 thickness necessary to prevent gamma ray exposure outside the cylinder 14. The walls may otherwise comprise a variety of radiation shielding materials. Almost any materials can be used for radiation shielding if employed in a thickness sufficient to attenuate the radiation to safe limits. The choice of the shielding material for the walls is dependent upon many varied factors, such as final desired attenuated radiation levels, ease of heat dissipation, resistance to radiation damage, required thickness and weight, multiple use considerations (e.g., shield and/or structural), uniformity of shielding capability, permanence of shielding, and availability.

The desired radiation attenuation is dependent upon the density of the shielding material; it can be shown that a dense shielding material with a higher atomic number is a better attenuator of gamma Rays. Lead enjoys the advantage of being the densest of any commonly available material and for this application has a good conductivity of heat. Other suitable dense material include tantalum, tungsten, depleted uranium, and thorium, which are higher on the density scale and usually prohibitive in cost. Pure lead itself cannot become highly radioactive under bombardment by gamma rays. Therefore, lead shielding, even after long periods of exposure, emits only insignificant amounts of radiation.

As the gas in the heating chamber 36 heats up, the principles of the Universal Gas Law applies. The increasing pressure due to the increase temperature forces the displacer 18 to the right, and the heated gas passes around the displacer 18 into the cooling chamber 38. This is encouraged by the reciprocating motion of the piston 22 towards the crank 26, which thereby reduces the pressure in the cooling chamber 38.

With continuing reference to FIG. 6, once the heated gas moves into the cooling chamber 38, the heat is passed out of the cooling chamber 38 by thermo convection through cooling fins 20 and into the surrounding environment. The piston 22 then moves towards the displacer 18, passing the cooled gas in the cooling chamber 38 back into the heating chamber 36. The movement of the displacer 18 towards the triggering element 16 is slower than the motion of the piston 22, thereby building up pressure in the heating chamber 36. Here again the X-rays from the triggering element 16 will expose the Hf material, and the cycle repeats.

Part of the uniqueness of this new Stirling Cycle is that it is based upon an internal heat source instead of the traditional external heat source.

With reference again to FIGS. 7A-7C, shown is a rotary nucleonic Stirling engine embodiment (RNSE 50) of a system for providing a rotational output using a non-combustion heat source. The RNSE 50 shown provides a number of advantages. For example, the RNSE 50 provides cylinder or modular scalability—multiple RNSE 50 may be stacked to provide a multiple module engine. Likewise, the RNSE 50 is scalable in size. The RNSE 50 may be scaled down (or up) to make for a small package that can provide long-term rotary endurance without an outside power source. The simplicity of the rotary design also minimizes the number of parts (moving or stationary), so that the RNSE 50 may be constructed within nano-motor limits. Nano-motor technology was a major breakthrough in 2002, but today it has moved onto nano-robots that use nano-motors for travel.

As shown, the RNSE 50 includes a rotor (or displacer) 52, rotor chamber 54, triggering elements 56, and a drive shaft 58. The rotor 52 in the embodiment shown is three-sided, with each side including a heat source 60. In the embodiment shown, the heat source 60 is a isomer plug made of Hafnium (Hf), which has been exposed to a nuclear reactor, in the form of a control rod or otherwise boosted to higher energy levels. The Hf isomer plug 60 may be the same or similar to the Hf isomer plug 12 shown in FIG. 6. The rotor 52 rotates around the rotor chamber 54 during the heat cycle, as is discussed in greater detail below.

With continued reference to FIGS. 7A-7C, the rotor chamber 54 typically includes a gas, or other substance, that is heated during the heating cycle and cooled during the cooling cycle. The heating and cooling of the gas provides the motivational force that rotates the rotor 52 around the rotor chamber 54. As shown, the rotor 52 divides the rotor chamber 54 into different temporary sections or sub-chambers as it rotates. For example, in FIG. 7A, the rotor chamber 54 includes heating sections 62 and cooling sections 64. Specifically, the triggering elements 56 have triggered or activated heat sources 60, heating the gas in the heating sections 62 during a heat cycle, while the gas in the two cooling sections 64 is cooling off during a cool cycle, after previously being heated during a heating cycle. In FIG. 7A, the triggering element 56 labeled "A" is activated, exposing the proximate heat source 60 to X-rays and causing that heat source 60 to release increasing amounts of heat (and gamma rays) into the corresponding heating section 62. The triggering element 56 labeled "B" is no longer activated; consequently, the heat source 60 passing through the corresponding heating section is not being exposed to additional X-rays and the amount of heat (and gamma rays) released by that heat source 60 has ceased increasing or shortly will cease increasing. The gas expands while being heated and contracts while being cooled, causing the displacer to move. As shown by FIGS. 7A-7C, the sections of the rotor chamber 54 defined by the rotor 52 change from heating sections 62 to cooling sections 64 as the rotor 52 moves.

The triggering element 56 activates the heat source 60 during the heating cycle. The triggering element 56 may be the same or similar to the triggering element 16 shown in FIG. 6. In other words, the triggering element 56 may be an X-ray source that releases X-rays into the rotor chamber 54, such as a low-level electron-volt (eV) generator of X-rays. For example, the triggering element 56 may be an X-ray source used in the dental industry for producing dental films. The X-rays excite the Hf, causing the internal energy bands of the Hf isomer plug 60 to be released in the form of heat (~95%) and gamma rays (~5%). The heat is used to energize the gas, or other substance, trapped in the rotor chamber 54. The interior walls of the rotor chamber 54, near the triggering element 56, may contain Hf alloy. As a result, the gamma rays are absorbed by the Hf alloy in the walls 66, which boosts their energy level and heat, thereby further heating the gas in the rotor chamber 54. Future exposure to X-rays will release the energy in a smaller proportion of heat. Using Hf alloy in the walls 66 reduces the thickness of the walls 66 necessary to prevent gamma ray exposure outside the RNSE 50. The walls 66 may otherwise comprise a variety of materials—see above description of possible shielding materials for cylinder 14 walls. Furthermore, the walls 66 may include additional shielding or insulation 68 in the areas proximate to the triggering elements 56. This shielding or insulation 68 insulate the heating sections 62, enabling a greater retention of heat in those areas, and to block gamma rays being released from the heat sources 60 to outside the RNSE 50. The shielding or insulation 68 may likewise comprise a variety of materials—see above description of possible shielding materials for cylinder 14 walls. The triggering element 56 may also be coupled with the displacer chamber 56 through an energy window bored in the walls 66, as described above with regards to FIG. 6.

With continuing reference to FIGS. 7A-7C, in operation the triggering element 56 may be itself activated, e.g., by the passing of the leading edge of the sides of the rotor 52 or the leading edge of the heat sources 60. The means for activating the triggering element 56 as such may be switches (not shown) located on the walls 66 that are depressed or otherwise activated by the leading edges of the rotor 52 or heat sources 60. Any other switching means known may be used. The trailing edges of the heat sources 60 or some other location chosen on the sides of the rotor 52, e.g., may de-activate the switches, and hence the triggering elements 56, in a like manner. Alternatively, e.g., the triggering elements 56 may be activated for a set amount of time, depending on the desired amount and duration of X-ray output. The activation period may start, e.g., when a leading edge of the rotor 52 or heat source 60 passes or some later time chosen to correspond to the heat source 60 passing directly over the triggering element 56. Likewise, e.g., the activation period may end when the heat source 60 has passed over the triggering element 56. When the RNSE 50 is starting from a stopped position, the triggering elements 56 may be, e.g., simply directly activated. The triggering elements 56 may be selectively activated, e.g., depending on their relative positions to the heat sources 60 For example, if first triggering element 56 is positioned near a heat source 60 while a second triggering element 56 is relatively far from a heat source 60, only the first triggering element 56 may be initially activated.

When the triggering elements 56 activate the heat sources 60, the gas, or other substance, in the rotor chamber 54 is heated. This causes the gas in the heating section(s) 62 to expand. The RNSE 50 shown is configured so that this expansion causes the rotor 52 to move, per the principles of the Universal Gas Law, rotating the rotor 52 in a clockwise (or counter-clockwise depending on desired configuration) manner. The gas in the cooling section(s) 64, on the other hand, contracts when it cools, creating a vacuum effect on the rotor 52 which also causes the rotor 52 to move in the configured direction (e.g., clockwise or counter-clockwise). Consequently, the expansion and contraction of the gas in the rotor chamber 54 work together to move the rotor 52.

The RNSE 50 may include additional cooling mechanisms, such as cooling fins (e.g., similar to cooling fins 20), liquid cooling, a radiator, and/or other known heat transfer mechanisms, to increase the rate of cooling and, therefore, contraction. With reference again to FIG. 7A, the embodiment shown includes liquid cooling pipes 70. The liquid cooling pipes 70 increase the efficiency of the cooling in the cooling sections 64 during the cool cycles. The liquid cooling pipes 70 may be controlled so that there is a greater flow of liquid adjacent to areas of the displacer chamber 54 actually in the cool cycle or those areas of the displacer chamber 54 that are almost always cooling sections 64 (to the right of bottom center and to the left of top center in FIGS. 7A-7C), thereby increasing cooling efficiency even further. Air cooling pipes may also be used.

The rotor 52 is coupled to a drive shaft 58 with an appropriate differential, therefore causing the drive shaft 58 to rotate in a similar manner around its axis, as illustrated in FIGS. 7A-7C. The drive shaft 58 may be coupled to another drive shaft or axle through an appropriate differential if necessary, providing a rotational driving force, in manners known to those skilled in the art. Likewise, multiple RNSE 50 may be coupled together to a drive shaft or axle (or similar mechanism) to provide additional rotational driving force and power.

The RNSE 50 may also include a base 72 (or other mounting devices) on which it is mounted. Like a combustion engine, the RNSE 50 may generate significant amounts of torque. It is important then that the RNSE 50 be appropriately mounted.

With continuing reference to FIGS. 7A-7C, the speed at which the rotor 52 rotates, and, therefore, the power the RNSE 50 generates, is directly proportional to the rate of expansion and contraction of the gas in the rotor chamber 54. The rate of expansion may be increased, e.g., by increasing the amount of X-rays output by the X-ray source. For example, X-ray source may output more X-rays over a shorter period of time. This will cause the Hf isomer to output heat and gamma rays at a greater rate. However, if the rate of contraction is not similarly increased, the slower contraction may produce resistance to the expansion of the heated gas, causing a drag on the rotor 52. There may also be limits on the expansion and contraction due to structural temperature sensitivity, maximum temperatures, and other limitations.

With reference to FIGS. 7 and 8A-8E, a consideration for applications of the system and method is the control of the embodiments described herein. The establishment of 'control' in any reaction is based on input and output. In the case of the embodiments here, control is based on control of the triggering mechanism (input) (e.g., triggering elements 16 and 56) and the resulting upper/lower temperature limits around the reaction (output) (e.g., the heat produced by the heat sources 12 and 60).

Fortunately, there is a direct link between the temperature limits and the triggering mechanism. That link is based on the heat retention capacity of the material surrounding the reaction area (e.g., surrounding the heat sources 12 and 60). In an embodiment, the next step to controlling the triggering mechanism is to then tie into the triggering control with a well-defined upper and lower temperature limit.

The upper limit is a function of the structural temperature sensitivity and speed of the engine (e.g., nucleonic Stirling engine 10 or RNSE 50). The engine does not need to be sacrificed for temperature or speed. An upper temperature limit is the temperature that will cause failure due to the melting of critical components, which can be defined by the components proximity to the heat source and the temperature sensitivity of the component material. As such, the engine 10 (and RNSE 50) may also include a temperature control mechanism that prevents the triggering element(s) from operating if the upper temperature limit is reached. Likewise, the temperature control may cause the triggering element(s) to activate if the lower temperature limit is inadvertently reached.

Temperature, as shown in the thermal dynamic model, is also the driving function the speed of the Stirling engine. Therefore, with increased temperatures the speed will increase and vise versa. See above, Stirling Thermal Engine—Theory, where the Schmidt theory is reviewed. Of the Schmidt symbols, "n" is the engine rotational speed and measured in Hz, or revolutions per second. This rotational value can be easily converted from revolutions per second (rps) to revolutions per minute (rpm). In Table 1b, the Indicated Power (Li) is the Indicated Energy (Wi) time the Engine Rotation Speed (n), and the Indicated Energy is the summation of the Indicated Expansion Energy (We) and the Indicated Compression Energy (Wc). The engine rotational speed "n" can be extracted from the integral of Engine Pressure (P) times the partial Momental Volumes (dV). (see Table 1a). In the section Stirling Thermal Engine—Example a temperature difference of 768 Kelvin would provide an Alpha type Stirling engine about 2,000 revolutions per minute. Part of the thermal dynamic model, addresses the delay of the increase/decrease in speed and a function of the immediate structural heat retention properties. If the material can retain the heat over a period of time, then less triggering is necessary. But, that also means a greater delay (reaction time) in speed control.

A system designed to run at an optimum torque and fixed speed would take advantage of material optimized for heat retention. This would reduce the number of triggering actions, and thereby improve the fuel efficiency. For example, such a system may be ideal for use as an electrical generator.

A system designed for changing speed would have an optimum torque and speed, but both the torque and speed would be a function of material. Any material used that did not retain heat would provide zero speed output. Unless the triggering was large and the fuel expendable in a short burst, otherwise the reaction itself would not be enough to drive the engine. Material with large heat retention would retain heat as described in the previous paragraph. So the thermal dynamic model would be used to define the heat retention limits surrounding the reaction area.

The lower limit is a point where heat output is not enough to drive the engine. The lower limit is directly linked to the lower torque limit, which is based on the links, and resistance of motion of the engine design. The fewer moving parts, or lubricated parts necessary, the lower the torque limits. As such, this defines the lower temperature limit.

In all cases, the cooling area must be most efficient in the distribution of heat. Carrying away as much heat from the gaseous media as possible improves the Stirling processing. The embodiments described herein are based on the temperature difference between the heated side and the cooling side. In optimizing the transference of heat away from the cooling area and fuel source, the thermal difference is improved and therefore the efficiency of the engine is improved.

Isomer Triggering

The triggering mechanism of the Isomer Reaction is the energy provided by a controlled and defined X-ray source, exposing the charged Hf material, as described above. The longer the X-ray source is on, exposing the Hf material, the greater the amount of gamma rays released, and then the higher the temperature of the reaction area. If the X-ray source has a variable output, then the higher the X-ray output, the higher the temperature of the reaction area. The temperature of the reaction area is a function of the surrounding material absorbing the gamma rays, and converting that energy to heat. It is estimated that 95% of the gamma energy will be converted to heat.

An optimum heat provides an optimum torque and speed of the engine. But, for a constant heat source, the temperature is directly proportion to the number of times the X-ray is allowed to irradiate the Hf source. With reference to FIG. 6, the trigger element 16 is powered only when the reaction material (the heat source 12) is close enough for an effective reaction with the X-ray. The same operational rule may be applied to the RNSE 50. It could be interpreted that the further away the displacer 16 the cooler the reaction. But, in reality, it would be that the further away the heat source 12 material, mounted in the head of the displacer 16, the weaker the gamma rays produced by the heat source 12. The absorption of the gamma rays by the surrounding walls 66 (and the gas or other substance) provides the heat. Specifically, when activated, Hf releases gamma rays which when shielded by materials in the walls 66 and shielding 68, such as lead, converts the absorbed energy of the gamma rays and releases new energy in the form of heat. This metal in turn heats the gas or other substance within the RNSE 50, which provides the pressure to move the displacer or rotor 52. Even the gas or other substance itself can be heated by the absorption of gamma rays, which in turn heat the gas or other substance.

The layout in FIG. 6 is like the traditional Stirling engine in that the heat source is nearly on all the time. The gamma rays released by the heat source are absorbed by the walls of the displacer chamber and released as heat. Like the traditional Stirling engine, the displacer chamber 18 walls then heat the chamber gas and the cycle begins. Yet, unlike the traditional Stirling engine, the fuel source is internal to the displacer chamber 18. Also, the control mechanism is more in line with the internal combustion engine, in that the energy (heat) necessary to move the piston (displacer) is only created during part of the cycle.

The system and method described herein have the following advantages:

- A modular motor design providing torque and power proportional to the number of modules
- Alternative power (rotary or voltaic) source that does not pollute or recycle atmospheric gases
- Power derived from recycled control rod material from nuclear reactors The system and method compete favorably with internal combustion and fuel-cell technology for the same reasons sighted above As described above, embodiments include a system and method that apply an internal heat source for a Stirling cycle engine and that utilize the simplicity of a rotary engine design. In these embodiments, the internal heat source is a nucleonic reactor that releases a large amount of heat and small percent of Gamma rays when a Hafnium isomer is exposed to X-rays. The heat captured by the internal gas and surrounding cylinder causes the cylinder gas to expand and thereby completing the first cycle of a Stirling cycle.

The Stirling cycle is based upon the heating and cooling of opposing chambers. In the RNSE engine, the secondary chamber is the cooling chambers for the gas. Therefore, the heated/expanded gas pushes the Rotor of the first compartment. This cooled gas wants to collapse the compartment or reduce the volume, thereby accentuating the rotary process. At the same time, a second chamber is undertaking a similar Otto cycle, to provide the necessary thrust to continue the rotary momentum. As there are three areas to the Wankel design, a third chamber completes the process of rotary momentum.

Unlike the rotary combustion engine (RCE), the Rotary Nucleonic Stirling Engine (RNSE) 50 does not pollute the trapped gas, and has such does not need to have the gas constantly replaced. Consequently, there is no exhaust. Another advantage is that a more ideal thermal exchange gas such as any liquid or gaseous fluorocarbon or chlorofluorocarbon products used as refrigerants will produce better and more efficient results. The implication here is that the internal chamber is not limited to gas(s).

Figure 8:
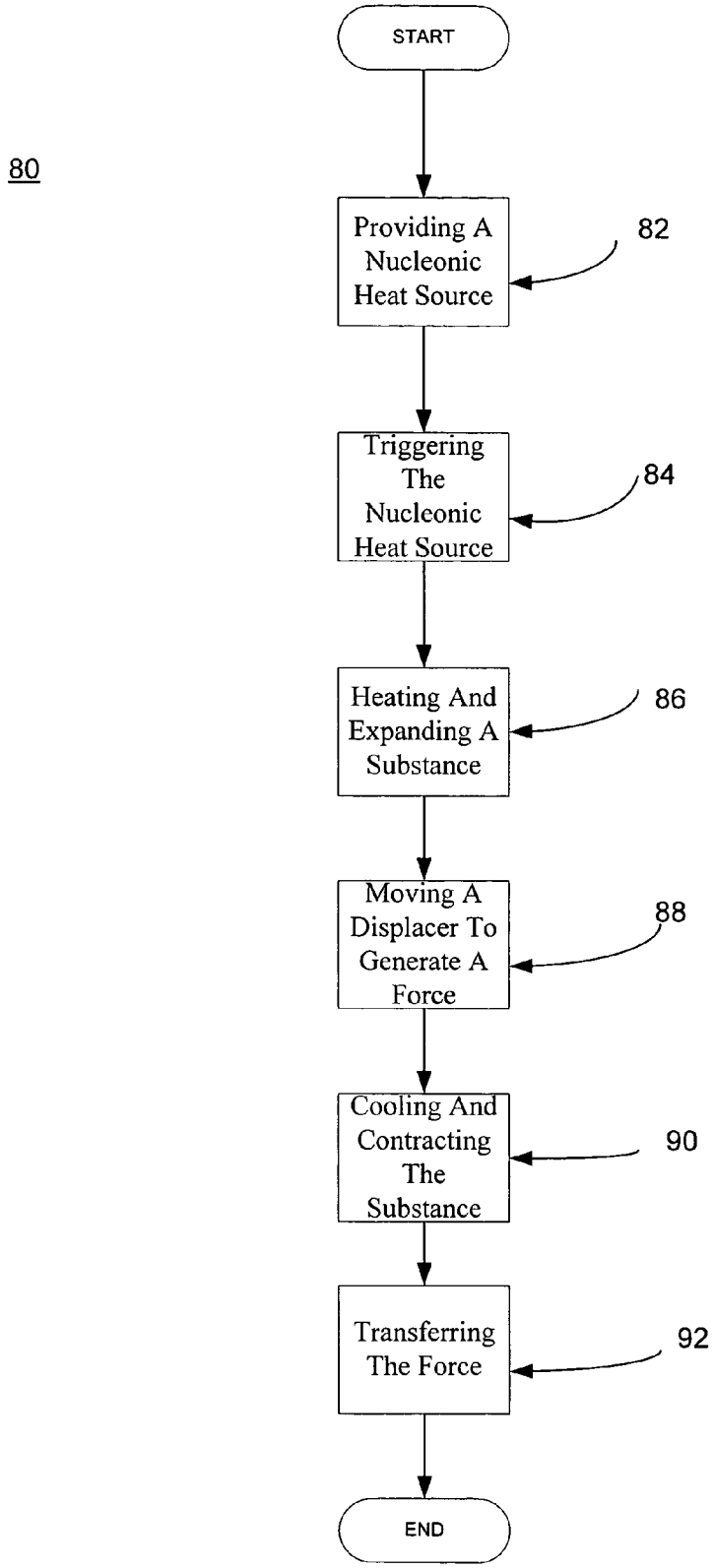
FIG. 8 is a flowchart illustrating an embodiment of a method for providing a rotational output using a non-combustion heat source.

With reference now to FIG. 8, shown is a flowchart illustrating a method 80 for providing a rotational output using a non-combustion heat source. The method 80 includes providing a nucleonic heat source (e.g., HF isomer), block 82, triggering the nucleonic heat source (e.g., by applying X-rays), block 84, heating and expanding a substance (e.g., a gas), block 86, moving a displacer (e.g., displacer 18 or rotor 52) to generate a force (e.g., rotational force), block 88, cooling and contracting the substance, block 90, and transferring the force, block 92. The method 80 may include additional or different steps as described herein.

Potential Applications

The system and method described herein have many potential uses. The system and method can serve in several capacities, e.g.: as an engine providing direct rotational drive, as a drive connected to a rotor and stator system to provide electrical power, and as a drive connected to an impeller to provide a rotary pump. Applications that can utilize these capabilities include:

1. Engine

Such an engine may include a battery to provide the initial power to initiate the resonant excitation of the nucleus (nucleonic process). Once started, the process would be similar to a conventional internal combustion engine (IC). Some of the power would be coupled to an alternator to recharge the battery for future startups and continue to power the induced resonant excitation. Much like an IC system, as more power is put into the X-ray system, the more X-ray energy will released, and more energy in the nucleonic process is released. Reducing the power to the X-ray system will directly (after a slight delay) reduce the energy to the nucleonic process and slow the rotation of the engine. Furthermore, removing power to the X-ray system will stop the nucleonic process and engine will slow to a stop. At this point there would be no residual energy being created or stored, except that in the engine block.

An engine as described would require more horse-power than a generator to provide propulsion during loads such as hills, starting from a stop, or acceleration. Combining or stacking multiple RNSEs in line can do this. The more stacks of RNSEs, the more horse-power generated, just as an IC engine gets more power from four, six, eight or twelve cylinders. This type of engine would provide long term continuous or even longer intermediate service because of the energy source potential. Just some examples are described in the following.

a. Such an engine could provide a direct rotational output to a transmission and drive train, through which a vehicle such as an automobile or other form of transport could be propelled. Such a transport would not require fuel stops and could be combined (solar hybrid) with solar power for added power and speed.

b. This direct rotational output could also be used to propel a transport that is not on the earth. An example would be a Lunar or Mars rover that would not require fuel, fuel cells, or solar power to provide the energy. Power is long term and replaceable. If necessary, the Hf could be transported easily by spacecraft. If the requirement is for colonization, then a reactor could be assembled on the planet to re-excite the Hf pellets, which could also be used as control rods for a nuclear reactor. The reactor would be like a recharger for a NiCd or Li battery.

c. A locomotive is another version of transport that can be propelled using such an engine. The engine could be used to propel metro trains, subways, or directly power electric trains. This would remove or reduce the reliance of such trains on high-power electrical services and free up the electrical power for other areas.

d. Such an engine could also provide a direct rotational output to a propeller, through which an aircraft can be propelled through the sky. Unlike conventional aircraft engines, this engine is non-breathing and is not limited to altitude or depth or requiring turbo charging to maintain fuel-mixture. It is also not susceptible to carburetor freezing, because there is not carburetor to mix fuel and air. The turning of a airplane propeller does not require the same horsepower found in an automobile, except for the initial assent or occasional climb to avoid weather or other aircraft. If speed is necessary, then stacking of RNSEs is an option.

e. Likewise, such an engine could provide a direct rotational output to a propeller, through which a surface ship maybe propelled on water. This engine would not need storage of fuel for long trips and as such would allow more cargo or passenger room. Also, by not carrying toxic fumes aboard the threat of fire is reduced during normal operations and during refueling, because there is no fuel.

f. Similarly, such an engine could provide a direct rotational output to a submarine propeller, through which a submarine can be propelled through the water. A dual power system would not be necessary as in non-nuclear submarine, saving space on batteries and fuel. Accordingly, the vessel could be made smaller or able to carry more provisions or weapons. Remote submarines are the most likely candidate for such a setup, where fuel and air require too much space or batteries have limited range and durance.

g. Another application would be in the direct or indirect (pulley and cable) drive of elevators or escalators in office buildings or department stores. Electrical power to move people vertically requires power to go up or down, almost equally. This would save on the building operating costs, and free up the power for other uses.

2. Generator

Such an engine described above could be used to rotate a rotor within a stator to create a generator. The generator can be configured in any number of power generation configurations. Single or three phase, with direct current (dc) power output determined by the rotational speed. The rotational speed can also be used to create alternating power (ac) where the rotational speed is the frequency of the output. A generator turning at 3,000 revolutions per minute (rpm) is a 50 Hz system, with is prevalent through out the world, with the exception of North America, which is 60 Hz (3,600 rpm). Combining or stacking multiple rotary nucleonic Stirling generators can be used to create more torque for more rotations (frequency) or phases (three motors, one for each phase). This type of power source can be used for emergency power, or supplemental power to an existing power grid.

a. Such a generator can be built for commercial or residential power during normal business operations, as backup to local utility outages, or even during times of disasters such as Hurricanes, Earthquakes, or Tornadoes. These can also be used during national emergencies such as the September 11 attack.

b. This type of generator can be used to store or recharge existing battery systems, to provide dc power when other sources are not available. An example might be to use this system of power during the night, when daylight solar power is not required and the demands at night are not as high.

c. Military applications can be to provide power during remote operations such as Desert Storm, or for remote sensor applications such as terrain seismic sensors to detecting the motion of people crossing remote locations that do not warrant human observations. Other military applications could include the powering of non-fuel vehicles like the electric Humvee®.

d. Currently, commercial and some private aircraft have an auxiliary power unit that runs on exotic fuels, the fumes of which are not healthy. This includes the Space Shuttle. This system could replace the auxiliary power unit with a non-breathing system.

3. Pump

An engine as described above could be used to rotate a impeller within a closed chamber to create a low or high-pressure area on each side of the intake and outtake of a pump. A pump is a slow turning unit that is below 1,000 rpm. This type of power could be used for emergency pumping where local power is not possible or has been lost due to an emergency.

a. Heating Ventilation and Air Conditioning (HVAC) or Heat Exchangers require a pump to more energy (heat) or lack of energy (cold) between the exchanger and the area to heated or cooled. This requires pumps that use a rotating crank to operate the pump. The rotary power could be provided by the RNSE described herein.

b. Continuous removal of waste or water from areas is a function of a pump. Whether it is in Holland, or other high-water areas, a RNSE can provide power to a pump for sewage recycling or water damage treats or real-time.

c. The RNSE can also be used in areas susceptible to dust explosions, but require continuously moving air. Such a system might be found in a tunnel or mine where gases are prevented from building up by fans. Air is moved into or out of a mine by fans. Similarly, air is moved in areas of fine dust, such as flourmills, bakeries, or other manufacturing areas were dust build up could be environmentally hazardous or unsafe for human occupancy.

4. Medical

An engine as described above could be used as an external capacity to provide long-term or short-term biological capabilities. Medical applications to a pump include system replacements such as: medical room blood circulation (during heart surgery), breathing assistance (iron-lungs), and blood dialyses systems.

Many other uses of the method and system described herein are apparent to one of ordinary skill. It is also recognized that alternative materials and fuel sources (e.g., heat sources 12 or 60) may be used. It should also be recognized that the method and system described herein are not limited to rotational outputs, but may produce other outputs as well.

As described herein, embodiments include a system and method that applies nucleonic reaction as an internal heat source of an Otto cycle engine, wherein the nucleonic reaction utilizes an electromagnetically triggered decay of a quasi-particle isomer, the quasi-particle isomer is chosen from a list comprising of Lutetium (Lu), Hafnium (Hf), and Tantalum (Ta), the nucleonic reaction only produces heat and Gamma ray energy during electromagnetic exposure, heat is dissipated by material thermal dynamic transfer and has a finite period to cool, gamma ray energy is only generated during the electromagnetic exposure, gamma ray energy instantaneously goes to zero when exposure is zero. Embodiments also include a system and method that applies a nucleonic reaction to a heat engine based on an internal heat source Stirling cycle design that includes a Stirling cycle engine utilizing an internal heat source for the expansion cycle point and an electromagnetic trigger.

Embodiments include a system and method that supplies and restores nucleonic reaction fuel source including a fuel source based upon high excitation energies stored in material with an atomic structure that inhibits rapid decay (e.g., quasi-particle isomers), wherein the fuel source is from original spent control material of a nuclear reactor, and wherein spent fuel sources can have their excitation energy restored by re-introducing them to a nuclear reactor. Embodiments include a system and method that applies the nucleonic reaction and internal heat source Stirling cycle to a rotary engine design, wherein the rotary engine design does not have an intake or exhaust cycle as found in an Otto cycle engine, the rotary engine design is based on an internal heat source Stirling cycle, and the rotary engine has a balanced cycle that utilizes multiple expansion cycle points within the rotary design and that centralizes the contraction cycle (cooling) point within the rotary design. Embodiments include a system and method that scales the design of the rotary nucleonic Stirling engine because of the minimum number of moving and stationary parts. As the thermal output is directly proportional to the volume of the gas to be heated, scaling reduces the thermal requirement, reducing the Gamma ray output, reduces the shielding (which allows for additional scaling), and reduces the X-ray energy requirement and hardware, wherein the scale is limited by the threshold of the gas used in the heat cycle and the size of the X-ray source. A balanced cycle that centralizes the contraction cycle (cooling) point within the rotary design. Embodiments include a system and method that utilizes cylinder wall material made of a quasi-particle isomer alloy, wherein utilizing a quasi-particle isomer alloy will absorb Gamma ray energy by raising the excitation level of the alloy and the percentage of the isomer content of the alloy reduces the required wall thickness or shield, thereby reducing Gamma ray levels outside the engine to below safe levels. A safe dosage for living tissue (humans) is less than 1 μrem/s.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

What is claimed is:

1. A system for providing a rotational output using a non-combustion heat source comprising:

a sealed chamber, wherein the sealed chamber contains a substance that expands when heated and contracts when cooled, wherein the substance state of matter remains unchanged, the sealed chamber including:

a displacer capable of rotationally moving within the sealed chamber, wherein the displacer rotationally moves, as a result of the substance expanding and contracting without undergoing phase transition, when the substance is heated; and a nucleonic heat source situated within the sealed chamber, wherein the heat source heats the substance when activated;

a triggering element, external to and coupled to the sealed chamber, wherein the triggering element activates the heat source; and means for translating the displacer movement into a rotational output.

2. The system of claim 1 wherein the sealed chamber is a cylinder.

3. The system of claim 1 wherein the substance is a gas.

4. The system of claim 1 wherein the heat source is Hafnium.

5. The system of claim 1 wherein the triggering element is an X-ray source.

6. The system of claim 1 further comprising an energy chamber that couples the triggering element to the sealed chamber.

7. The system of claim 1 wherein the sealed chamber includes one or more heating sections in which the substance is heated and expands.

8. The system of claim 7 wherein the sealed chamber includes radiation shielding proximate to the one or more heating sections.

9. The system of claim 1 wherein the sealed chamber includes one or more cooling sections in which the substance is cooled and contracts.

10. The system of claim 9 wherein the sealed chamber includes liquid cooling tubes proximate to the one or more cooling sections.

11. The system of claim 9 further comprising heat sinks coupled to the sealed chamber proximate to the one or more cooling sections.

12. The system of claim 1 where in the sealed chamber is a rotary engine chamber.

13. The system of claim 1 wherein the displacer is rotor.

14. The system of claim 1 wherein the translating means includes a crank.

15. The system of claim 1 wherein the translating means includes an axle.

16. The system of claim 1 wherein the system is a rotary engine.

17. The system of claim 1 wherein the system is a Stirling engine.

18. The system of claim 1 wherein the system comprises a plurality of rotary engines coupled together, each rotary engine comprising a sealed chamber and a triggering element coupled to the sealed chamber.

19. The system of claim 1 wherein the system is a generator that generates voltaic output.

20. The system of claim 1 wherein the system is a pump.

21. A method for providing a rotational output using a non-combustion heat source comprising:

triggering a nucleonic heat source;

heating and expanding a substance within a sealed chamber, without causing a phase transition in the substance, wherein the substance state of matter remains unchanged;

rotationally moving a displacer in the sealed chamber with the expanded substance to generate a force, wherein the expanding substance causes the displacer to rotationally move; and transferring the generated force.

22. The method of claim 21, further comprising cooling and contracting the expanded substance.

23. The method of claim 21 wherein the substance is a gas.

24. The method of claim 21 wherein the nucleonic heat source is Hafnium.

25. The method of claim 21 wherein triggering a nucleonic heat source includes generating X-rays.

26. The method of claim 21 wherein the nucleonic heat source is located within the sealed chamber.

27. The method of claim 21 wherein transferring the generated force includes driving a crank with the displacer.

28. The method of claim 21 wherein transferring the generated force includes driving an axle with the displacer.

29. The method of claim 21 wherein the displacer is a rotor.

30. A rotary engine for providing an output using a non-combustion heat source comprising:

a sealed, rotary chamber, wherein the sealed, rotary chamber contains a substance that expands when heated and contracts when cooled, wherein the substance state of matter remains unchanged, the sealed rotary chamber including;

a rotor capable of rotating within the sealed, rotary chamber, wherein the rotor rotates, as a result of the substance expanding and contracting without undergoing phase transition, when the substance is heated; and a nucleonic heat source situated within the sealed, rotary chamber, wherein the nucleonic heat source heats the substance when activated; and a triggering element, external to and coupled to the sealed, rotary chamber, wherein the triggering element activates the nucleonic heat source.

31. The rotary engine of claim 30 further comprising means for translating the rotor movement into a rotational output.

32. The rotary engine of claim 30 wherein the nucleonic heat source is located on the rotor.

33. The rotary engine of claim 30 wherein the rotor includes a plurality of sides and the triggering element is configured to activate the nucleonic heat source when each side of the rotor passes the triggering element.

34. A Stirling engine for providing an output using a non-combustion heat source comprising:

a sealed cylinder, wherein the sealed cylinder contains a substance that expands when heated and contracts when cooled, wherein the substance state of matter remains unchanged, the sealed cylinder including:

a displacer capable of moving within the sealed cylinder, wherein the displacer rotationally moves, as a result of the substance expanding and contracting without undergoing phase transition, when the substance is heated; and a nucleonic heat source situated within the sealed cylinder, wherein the nucleonic heat source heats the substance when activated; and a triggering element, external to and coupled to the sealed cylinder, wherein the triggering element activates the nucleonic heat source.

35. The Stirling engine of claim 34 further comprising a piston located within the sealed cylinder, wherein the piston reciprocally moves with the displacer.

36. The Stirling engine of claim 34 wherein the nucleonic heat source is located on the displacer.

37. The Stirling engine of claim 34 wherein the triggering element is configured to activate the nucleonic heat source when the displacer is proximate to the triggering element.

38. The Stirling engine of claim 34 further comprising a crank coupled to the displacer for translating the displacer movement into a rotational output.

* * * * *